US006598506B2

(12) United States Patent
Gämmerler et al.

(10) Patent No.: US 6,598,506 B2
(45) Date of Patent: Jul. 29, 2003

(54) CUTTING APPARATUS

(75) Inventors: Gunter Gämmerler, Gelting (DE); Ralf Elvert, München (DE); Helmut Schirmacher, Höhenkirchen (DE)

(73) Assignee: Gämmerler AG, Geretsried-Gelting (DE)

( * ) Notice: Subject to any disclaimer, the term of this patent is extended or adjusted under 35 U.S.C. 154(b) by 0 days.

(21) Appl. No.: 09/918,778

(22) Filed: Jul. 31, 2001

(65) Prior Publication Data

US 2002/0017174 A1 Feb. 14, 2002

(30) Foreign Application Priority Data

Aug. 2, 2000 (DE) ..... 100 37 709

(51) Int. Cl.[7] ..... B26D 1/00
(52) U.S. Cl. ..... 83/13; 83/62.1; 83/522.12
(58) Field of Search ..... 83/13, 522.12, 83/62, 62.1, 74, 75, 583

(56) References Cited

U.S. PATENT DOCUMENTS 3,186,275 A * 6/1965 Obenshain
3,359,843 A * 12/1967 Mead
3,540,340 A * 11/1970 Koskela ..... 83/499
3,645,156 A * 2/1972 Meyer et al. ..... 83/9
3,739,674 A * 6/1973 Zychal et al. ..... 83/651
3,744,362 A * 7/1973 Gesell et al. ..... 83/62
3,926,081 A * 12/1975 Roberts ..... 83/96
4,426,897 A * 1/1984 Littleton ..... 83/37
4,984,490 A * 1/1991 Kurki ..... 83/13
5,029,503 A * 7/1991 Perrone ..... 83/62
5,992,279 A * 11/1999 Hinz ..... 83/13

FOREIGN PATENT DOCUMENTS

DE 196 32 438 2/1998
DE 196 43 261 4/1998

* cited by examiner

*Primary Examiner*—Derris H. Banks
*Assistant Examiner*—Jamila Williams
(74) *Attorney, Agent, or Firm*—Fitch, Even, Tabin & Flannery

(57) ABSTRACT

A monitoring device for the spacing between the knives is provided in a rotation cutting apparatus having a rotation cutting knife and a counter-knife which partly overlap in the cutting region and form a cutting gap.

12 Claims, 4 Drawing Sheets

CUTTING APPARATUS

DESCRIPTION

1. Field of the Invention

The present invention relates to a rotation cutting apparatus in accordance with the preamble of claim 1 having a rotation cutting knife and a counter-knife which partly overlap in the cutting region and which form a cutting gap.

2. Background of the Invention

Such rotation cutting apparatuses are generally known and are used, for example, for the cutting of paper products in print post-processing. One-piece round knives or multi-part knives are used as the rotation knives and have single blades arranged at the periphery of a round, disk-like base body. The counter knife can be fixed or likewise rotate. It can furthermore be formed as a cylinder whose one edge serves as the shear edge for the rotation knife in the cutting region, whereby a shear-like cut can be achieved.

The cutting gap between the knives is provided in order to avoid wear of the knives due to mutual contact. The cutting gap must be very small, for example some hundredths of a millimeter, for a good cut.

However, during the operation of the apparatus, both the bearings of the knives heat up due to friction and the knives themselves heat up due to friction between the blades or the base bodies of the knives and the paper products. The heat expansion of the bearings and the cutting knives resulting from this leads to a reduction in the cutting gap width. In the event of too high a heating up, and thus a heat expansion, the cutting gap can disappear altogether so that the cutting knives come into contact, whereby the blades are, on the one hand, further heated due to their mutual rubbing and, on the other hand, are subject to increased wear. In the most unfavorable case, splintering can also result at the blades. The latter results in inexact cuts so that waste and unwanted down times arise when the knife has to be repaired or resharpened.

SUMMARY OF THE INVENTION

It is the object of the invention to provide a rotation cutting apparatus of the kind first mentioned which produces less waste and in which fewer down times are possible.

The object is satisfied by a rotation cutting apparatus having the features of claim 1.

A rotation cutting device of the invention has a rotation cutting knife and a counter-knife which overlap in the cutting region and form a cutting gap there. The blades do not necessarily have to be arranged in parallel; they can also be bent with respect to one another and/or have a clearance angle.

The rotation knife can be formed in one piece or in a plurality of parts. In the latter case, it can, for example, have a round, disk-like base body at whose periphery a plurality of individual blades or knives are fastened which can moreover be attached in adjustable manner. The rotation cutting knife can furthermore be formed as an upper or a lower knife. The counter-knife can be fixed or also rotate itself, with it being itself formed as a rotation cutting knife or also, preferably, as a cylinder whose edge opposite to the rotation cutting knife works as a shear edge.

In accordance with the invention, when a cutting gap is present, the electrically conductive blade of the rotation cutting knife is electrically insulated with respect to the electrically conductive blade of the counter-knife. This can take place, for example, by a holding in electrically insulating materials such as plastic or ceramics or by providing appropriate intermediate layers between the blade and the knife or the knife and an associated holding or bearing apparatus, or by insulating bearings such as ball bearings with ceramic balls.

The rotation cutting apparatus has a monitoring device with two inputs, with one input in each case being electrically conductively connected to the blade of a knife. The monitoring device monitors the DC or AC resistance betweens its inputs and emits a signal when the DC resistance or the reactive current portion of the AC resistance falls below a threshold value.

The threshold value is pre-set such that it is fallen short of on the contact of the blades. For a monitoring of the DC resistance, it is larger than the sum of the resistances of the connections between inputs and blades and the contact resistance between the blades, if these contact without pressure. For a monitoring of the AC resistance, the threshold value is larger than the reactance of the connection from the one input of the monitoring device via the blades touching without pressure to the other input of the monitoring device at a frequency pre-set by the signal device.

If the cutting gap between the blades reduces so much in the cutting region that the blades touch, the DC resistance or the reactive current portion of the AC resistance, which is decisively determined by the cutting gap width, drops below the threshold value between the inputs of the monitoring device, whereby a signal is triggered.

The monitoring of the reactance can also take place in the monitoring device in particular by a monitoring of the phase, substantially determined by the reactance, between voltage and current at the inputs or the amplitude of the AC current for a given voltage.

The signal can be triggered by a reduced resistance value. In this case, the signal is only emitted when the DC resistance or the reactance is lowered for a minimum period which depends, among other things, on the design of the monitoring device. "Falling short of the threshold value" then means that the falling short of, and thus a contact of the blades, must take place for a certain minimum period. To allow recognition of contact of the blades as early as possible, it is advantageous if the monitoring device reacts even when the threshold value is only fallen short of very briefly, for which purpose it can, for example, advantageously have an appropriately designed sample and hold circuit.

The emission of the signal preferably already takes place on the recognition of a drop in the resistance or the reactance below the threshold value since, in this way, a response is also possible to contacts only lasting a very brief time, such as can occur at high rotation speeds of the rotation cutting knife.

The signal can last for so long as the threshold value is fallen short of; however, it can also be emitted for a pre-set longer period, for example to show that a readjustment of the cutting gap width is necessary.

The rotation cutting device of the invention or the method of the invention allows a very simple, but effective monitoring of the cutting gap width. It is possible due to the monitoring to work with very small cutting gap widths without the risk of excessive wear of the blades of the knives occurring. Furthermore, splintering at the knives and losses associated therewith due to poor cutting and downtimes are avoided.

Preferred further developments of the invention are described in the description, the drawings and the dependent claims.

In a preferred embodiment of the rotation cutting apparatus or of the method of the invention, a visual signal can be emitted, for example in the form of a lamp lighting up or a corresponding display, on the touching of the blades and the drop below the threshold value caused by this in the DC resistance or the reactive current portion of the AC resistance. This has the advantage that the signal can also be perceived with substantial environmental noise.

In the simplest case, the monitoring device has a series connection of a voltage source and a light source between the inputs for this purpose.

In a further preferred embodiment of the rotation cutting apparatus or of the method, an acoustic signal can be emitted on the touching of the blades and the drop below the threshold value caused by this in the DC resistance or the reactive current portion of the AC resistance. This is particularly of advantage if the operator cannot permanently observe a display.

In the simplest case, the monitoring device has a series connection of a voltage source and a horn between the inputs.

In a further preferred further development of the rotation cutting device or of the method, the cutting gap width is automatically enlarged on the contact of the blades.

The rotation cutting apparatus can have a setting device for the adjustment of the cutting gap width for this purpose. The setting device can be controlled by a signal of the monitoring device and enlarges the cutting gap width by a movement of the rotation cutting knife and/or counter-knife in response to a signal fed to it by the monitoring device.

An adjustment of the cutting gap width is also possible in a particularly advantageous manner in this way during on-going operation. Unnecessary wear of the blades is avoided in a particularly effective manner since the enlarging of the cutting gap takes place without a delay, whereas otherwise intervention by the operator is necessary. Furthermore, as a result of the short reaction time, the cutting gap width can be kept small without risk, which results in very good cutting.

In an embodiment, the enlargement only takes place during the period of the signal. However, particularly with multi-part knives, it can happen that only a small region of the knife triggers a signal which then only lasts a very short time at a high rotation speed. In another embodiment, it is therefore preferred for the cutting gap width to be enlarged by a pre-set amount in response to a signal, with no further signals being taken into account during the enlarging.

The setting device can be formed such that, at given times, the cutting gap width is reduced very gradually by a certain spacing, at the most, however, until it is fed a signal from the monitoring device. Generally, the spacing reduction is terminated immediately and the cutting gap is enlarged again if a signal is triggered in the monitoring device by a contact of the blades. The monitoring device can also be designed such that a desired cutting gap width is automatically set during or after a cooling down of the apparatus due to an interruption to operation.

This design of the setting device makes it possible to regulate the cutting gap width, i.e. to again reduce the enlarged cutting gap width enlarged due to cooling, in particular also on cooling of the knives and bearings. Finally, this further development allows the automatic setting of the cutting gap width at the start of operation and/or after interruptions to operation.

In accordance with a further advantageous embodiment of the invention, a sliding contact is provided to make an electrical contact to the shaft of the rotation cutting knife or the counter-knife. In this embodiment, a correct contact is always ensured which is independent of a heating or cooling down of the machine. It can, in contrast, be problematic to make the contact via the bearings of the shaft, since the inner resistance of the bearings alters in dependence on their temperature.

Preferred embodiments of the invention are now described by way of example with reference to the drawings.

DETAILED DESCRIPTION OF THE PREFERRED EMBODIMENTS

Figure 1:
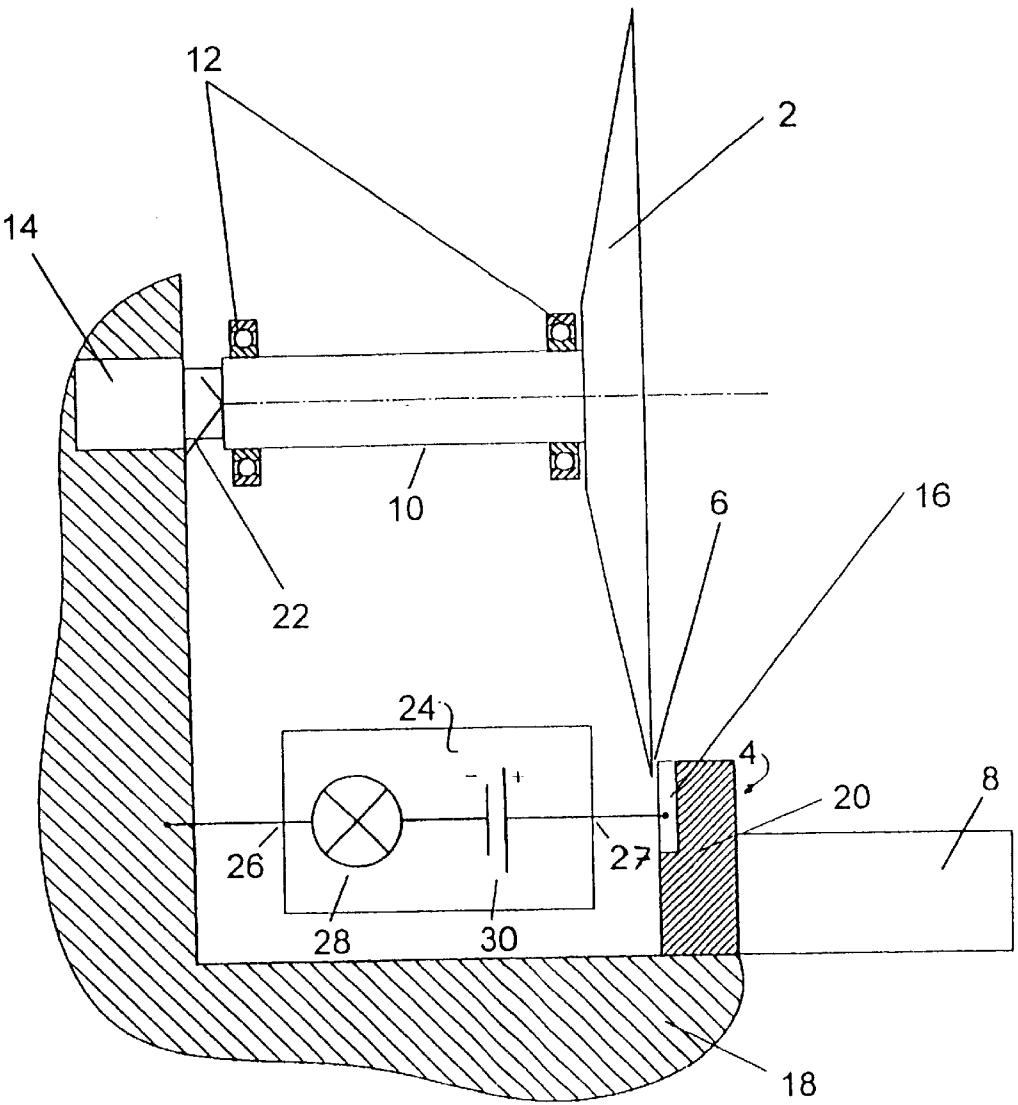
FIG. 1 shows a schematic, partly sectional side view of a rotation cutting apparatus in accordance with a first embodiment.

In FIG. 1, a rotation cutting apparatus for paper products in accordance with the invention has a rotation knife 2 as an upper knife and a counter-knife 4 as a lower knife which overlap in the cutting region and form a cutting gap 6.

The upper knife 2 is attached to a shaft 10 which is supported in bearings 12 and is driven by a drive unit 14. The counter-knife 4 has a blade 16 with a shear edge which is fastened in a holder 20 of electrically insulating material, for example plastic or ceramics. The holder 20 and the drive unit 14 are fixedly connected to one another via a frame 18. Together with the rotating blade of the rotation knife 2, a drawing, shear-like cut can be achieved with the aid of the counter-knife 4.

The width of the cutting gap 6 can be set by means of a setting device 8, for example with the aid of hand cranks, by displacement of the holder 20. The mechanics for this purpose are known to one skilled in the art. The width of the cutting gap can be in the region from around 3/100 mm for a good cutting of paper products.

The rotation knife 2 and the shaft 10 are made of metal so that the blade of the rotation knife 2 is electrically conductively connected to the frame 18 via a spring sliding contact 22 adjoining the shaft 10 and electrically conductively fastened to the metal frame 18, but is insulated with respect to the electrically conductive blade 16 of the counter-knife 4 by the electrically insulating holder 20.

The frame 18, and thus the blade of the rotation cutting knife 2, and the blade 16 of the counter-knife are connected to the two inputs 26, 27 of a monitoring device 24 which has a series connection of a lamp 28 and a DC power source 30 between the inputs 26. An AC power source can also be used.

Figure 1A:
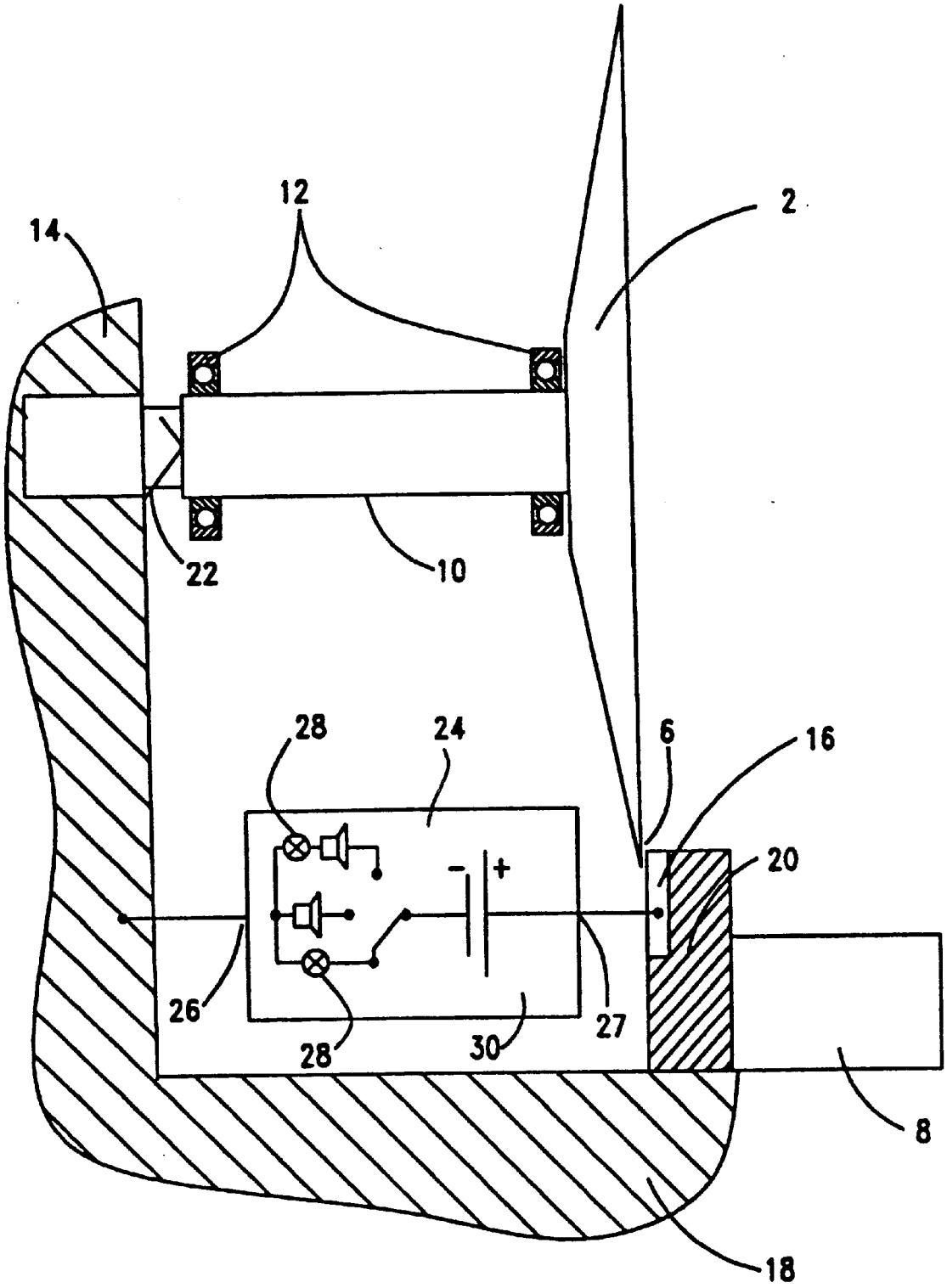
FIG. 1A is a schematic view similar to FIG. 1 showing an alternative signaling arrangement.

If the width of the cutting gap 6 reduces so much due to heat expansion that the blades of the rotation knife 2 and the counter-knife 4 come into contact, the resistance between the spaced blades becomes very small and the inputs of the monitoring device are bridged or short-circuited. As a result, the circuit of the lamp 28 and the power source 30 is closed so that the lamp lights up and emits a visual signal. Alternatively or in addition, an acoustic signal can be emitted (FIG. 1A).

Figure 2:
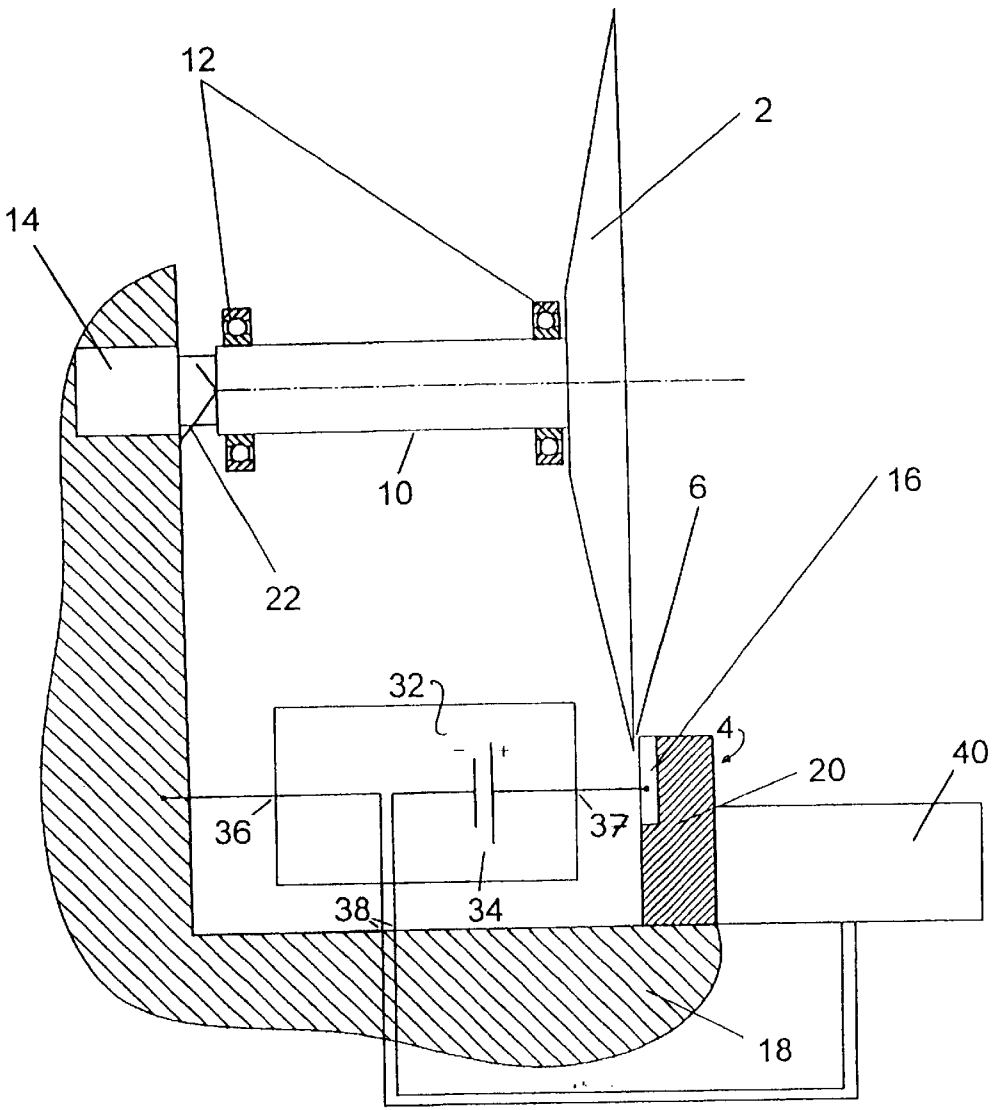
FIG. 2 shows a schematic, partly sectional side view of a rotation cutting apparatus in accordance with a second embodiment.

A second preferred embodiment of the invention is shown in FIG. 2. Both embodiments differ only in the design of the monitoring device and the setting device.

In this embodiment, the monitoring device 32 has a DC power source 34, two inputs 36, 37 and two outputs 38, of which one is connected directly to the input 36 and the other to the input 37 via the power source 34. On contact of the blades, the voltage of the power source 34 is thus applied to the outputs 38 as a signal.

Figure 2A:
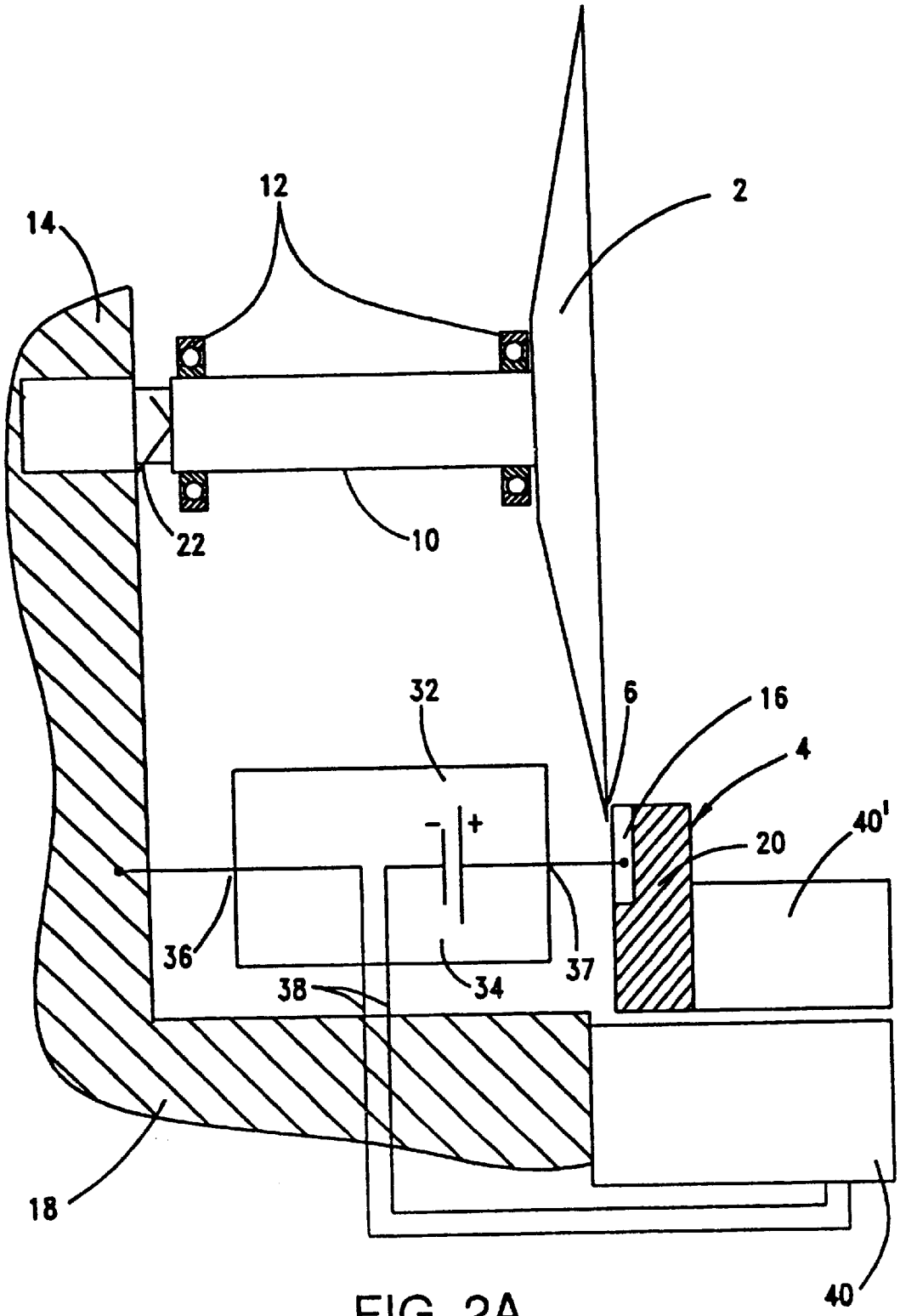
FIG. 2A is a schematic vie similar to FIG. 2 showing an alternative setting device arrangement.

The setting device 40 for the setting of the cutting gap, which is connected to the monitoring device, is designed such that it moves the counter knife holder 20 away from the rotation knife 2 by a pre-set distance, e.g. by 3/100 mm, in response to a signal, that is to an increase in the voltage at its inputs. Alternatively, the setting device 40 is operable to shift the frame holder 18 for the rotation knife 2, with there being separate setting device 40' for shifting of the counter knife holder 20, as shown in FIG. 2A. For this purpose, it can have a setting unit known to one skilled in the art, for example and electronically controlled electric drive with a spindle. Preferably, a motor (not shown) is used here which allows a rapid movement of the holder 18 and/or 20 so that the time period during which the blades are in contact is as short as possible.

What is claimed is:

1. A rotation cutting device having a rotation cutting knife and a counter-knife which each have an electrically conductive blade, partly overlap in the cutting region and form a cutting gap, wherein the blade of the rotation cutting knife and the blade of the counter-knife are each electrically insulated with respect to one another; and wherein the blade of the rotation cutting knife and the blade of the counter-knife are each electrically connected to an input of a monitoring device which monitors the electric resistance between the two inputs and emits a signal when the resistance falls short of a pre-set threshold value.

2. A rotation cutting apparatus in accordance with claim 1, wherein the monitoring device has a signal source which emits a visual and/or acoustic signal when the threshold value is fallen short of.

3. A rotation cutting apparatus in accordance with claim 1, wherein the monitoring device has a series circuit of a power source and a light source and/or sound source interposed between the two inputs.

4. A rotation cutting apparatus in accordance with claim 1, wherein the monitoring device monitors the DC resistance or the reactive current portion of the AC resistance.

5. A rotation cutting apparatus in accordance with claim 1, wherein a setting device is provided which is connected to the monitoring device and which serves for the setting of the cutting gap, with the setting device being formed such that it enlarges the width of the cutting gap by moving the rotation cutting knife and/or the counter-knife in response to a signal fed from the monitoring device.

6. A rotation cutting apparatus in accordance with claim 5, wherein the setting device enlarges the cutting gap by a pre-set amount in response to the signal.

7. A rotation cutting apparatus in accordance with claim 5, wherein the setting device regulates the width of the cutting gap to a desired value on the basis of signals from the monitoring device.

8. A method for the monitoring of the cutting gap width of a rotation cutting apparatus having a rotation cutting knife and a counter knife which partly overlap in the cutting region, form a cutting gap and have the respectively electrically conductive blades which are electrically insulated with respect to one another, in which method the DC or AC resistance between the blades is monitored and a signal is emitted when the DC resistance or the reactive current portion of the AC resistance fails short of a pre-set threshold value.

9. A method in accordance with claim 8, wherein a visual and/or acoustic signal is emitted.

10. A method in accordance with claim 8, wherein the cutting gap is changed, in particular enlarged, by a setting device in response to the signal of the monitoring device by a movement of the rotation cutting knife and/or the counter-knife.

11. A method in accordance with claim 10, wherein the cutting gap is enlarged by a pre-set amount in response to the signal.

12. A method in accordance with claim 10, wherein the width of the cutting gap is regulated on the basis of signals triggered by the threshold value being fallen short of.

* * * * *